US009261266B2

(12) United States Patent
Watanabe

(10) Patent No.: US 9,261,266 B2
(45) Date of Patent: Feb. 16, 2016

(54) LIGHT EMITTING APPARATUS

(71) Applicant: LAPIN CREATE, INC., Nerima-ku, Tokyo (JP)

(72) Inventor: Masaru Watanabe, Tokyo (JP)

(73) Assignee: LAPIN CREATE, INC., Nerima-Ku, Tokyo (JP)

( * ) Notice: Subject to any disclaimer, the term of this patent is extended or adjusted under 35 U.S.C. 154(b) by 0 days.

(21) Appl. No.: 14/827,922

(22) Filed: Aug. 17, 2015

(65) Prior Publication Data

US 2015/0354798 A1 Dec. 10, 2015

Related U.S. Application Data

(63) Continuation of application No. 14/127,238, filed as application No. PCT/JP2012/004667 on Jul. 23, 2012, now Pat. No. 9,127,831.

(30) Foreign Application Priority Data

Jul. 22, 2011 (JP) ..... 2011-160644
May 7, 2012 (JP) ..... 2012-105756

(51) Int. Cl.
*F21V 23/04* (2006.01)
*F21V 21/40* (2006.01)
(Continued)

(52) U.S. Cl.
CPC ..... *F21V 23/0414* (2013.01); *F21V 21/406* (2013.01); *H05B 33/0845* (2013.01); *F21Y 2113/005* (2013.01)

(58) Field of Classification Search
CPC ..... F21V 23/0414; F21V 23/0492; F21V 21/406; F21L 4/02
USPC ..... 362/184, 249.02, 249.13
See application file for complete search history.

(56) References Cited

U.S. PATENT DOCUMENTS 5,050,053 A 9/1991 McDermott
2006/0092623 A1* 5/2006 Irisawa ..... F21L 4/02 362/102

(Continued)

FOREIGN PATENT DOCUMENTS

JP 2002-298602 A 10/2002
JP 3129821 U 2/2007

(Continued)

OTHER PUBLICATIONS

International Search Report (PCT/ISA/210) mailed on Aug. 21, 2012, by the Japanese Patent Office as the International Searching Authority for International Application No. PCT/JP2012/004667.

(Continued)

*Primary Examiner* — David V Bruce
(74) *Attorney, Agent, or Firm* — Buchanan Ingersoll & Rooney PC

(57) ABSTRACT

A portable light emitting apparatus (1) includes: a tube-like grip (10) held by the hand (90); a light emitting unit (50) that is attached to one end (11) of the grip (10), houses LEDs (61) to (63), and outputs light of at least three different colors individually or in a mixture; and three color switches (21) to (23) that are disposed at positions pressed by a first finger (92), a second finger (93), and a third finger (94) on the grip (10) and operate a first function that carries out on/off control of light of the different colors.

6 Claims, 10 Drawing Sheets

(51) Int. Cl.

| | |
|---|---|
| ***H05B 33/08*** | (2006.01) |
| *F21Y 113/00* | (2006.01) |

(56) References Cited

U.S. PATENT DOCUMENTS

| | | | |
|---|---|---|---|
| 2010/0046211 | A1 | 2/2010 | Spartano et al. |
| 2010/0214470 | A1 | 8/2010 | Cottagnoud |

FOREIGN PATENT DOCUMENTS

| | | | |
|---|---|---|---|
| JP | 2010-135988 | A | 6/2010 |
| JP | 3168514 | U | 6/2011 |
| WO | WO 2009/026954 | A1 | 3/2009 |

OTHER PUBLICATIONS

Written Opinion (PCT/ISA/237) mailed on Aug. 21, 2013, by the Japanese Patent Office as the International Searching Authority for International Application No. PCT/JP2012/004667.

Notification of Transmittal of Translation of the International Preliminary Report on Patentability (Forms PCT/IB/338 and PCT/IB/373) and the Written Opinion of the International Searching Authority (Form PCT/ISA/237) issued on Feb. 6, 2014, by the International Bureau of WIPO in corresponding International Application No. PCT/JP2012/004667. (7 pages).

The extended European Search Report issued on Feb. 10, 2015, by the European Patent Office in corresponding European Application No. 12818002.3-1757. (6 pages).

* cited by examiner

LIGHT EMITTING APPARATUS

CROSS-REFERENCE TO RELATED APPLICATIONS

The present application is a continuation of U.S. Ser. No. 14/127,238, filed on Dec. 18, 2013, which is a national stage application of PCT/JP2012/004667, which was filed on Jul. 23, 2012, which claims the priority of JP 2012-105756, filed on May 7, 2012; and JP 2011-160644, filed on Jul. 22, 2011. The subject matter of PCT/JP2012/004667; JP 2012-105756; and JP 2011-160644 are incorporated herein by reference.

TECHNICAL FIELD

The present invention relates to a portable light emitting apparatus that can be held and moved with one hand.

BACKGROUND ART

Japanese Laid-Open Patent Publication No. H09-282902 (hereinafter "Publication 1" discloses a light emitter, such as a pen light, that is made smaller and can be manufactured at low cost through simplification of the switch construction. To do so, Publication 1 states that a light emitting barrel composed of a translucent tube and a grip tube are detachably screwed together, an electrical circuit board with a conductive film formed on one side is disposed between the two tubes, a light emitting element is attached to the electrical circuit board, and a power supplying electrode (the cathode of a cell or an electrode end of a spring) is disposed facing the conductive film of the electrical circuit board and is elastically pressed toward the electrical circuit board by a spring, thereby enabling the electric circuit board to be used as part of a switch.

DISCLOSURE

There is demand for a light emitting apparatus allowing users to output light (i.e., emit light) in a variety of spaces and situations, such as at a concert.

A first aspect of the present invention is a portable light emitting apparatus including: a grip held by the hand; a light emitting unit that is integrated with the grip, houses a plurality of light emitting elements, and outputs light of at least three different colors individually or in a mixture; and a plurality of color switches that are disposed at positions pressed by at least three out of a first finger (index finger), a second finger (middle finger), a third finger (ring finger), and a fourth finger (little finger) on the grip and operate a first function that carries out on/off control of light of the different colors.

This light emitting apparatus is capable of being held by the user in one hand or in both hands with it being possible for the user to move his/her body, arms, or the like so that the light emitting apparatus traces various paths. As one example by merely pressing the index finger, the middle finger, the ring finger, or the little finger while moving the body or the like in a state where the grip is gripped with one hand, the user can operate a plurality of color switches. Accordingly, the user can variously control the path of light outputted from the light emitting unit, the color of light outputted from the light emitting unit, and the timing at which light is emitted from the light emitting unit.

The grip should preferably include a plurality of concave portions where parts where at least three out of the index finger, the middle finger, the ring finger, and the little finger are placed are depressed respectively, and the plurality of color switches should preferably be disposed in the plurality of concave portions.

If the positions where the respective fingers are placed are depressed, it becomes easy to hold (grip) the grip and to move the light emitting apparatus with one hand. If the respective color switches are also disposed in the depressed parts where the respective fingers are placed, by merely moving the respective fingers, it becomes possible to operate desired color switches without confirming the respective color switches every time or searching for the positions of the color switches. Accordingly, it is possible to switch light of a desired color on/off at desired timing according to movement of the fingers and a pattern (fingering) of moving the fingers, so that the use of the light emitting apparatus can be mastered in the same way as a stringed instrument (such as a guitar) or a wind instrument (such as a trumpet).

The light emitting apparatus should preferably include a switching pattern or patterns that change functions operated by the plurality of color switches, the switching pattern including an operation of predetermined color switches among the plurality of color switches with a predetermined procedure. The function operated by the color switches can be expanded with respect to a first function of on/off control of the individual lights of different colors. As the procedure (algorithm) of the color switches for switching or expanding the function, it is possible to use a characteristic or different operation compared to a normal on/off operation of the colors. As examples, the procedure may be simultaneously operating all of the switches a plurality of times, or simultaneously releasing all of the switches after pressing for a predetermined number of seconds.

The light emitting apparatus should preferably also include: a program control unit that controls light outputted from the light emitting unit in accordance with one of a plurality of patterns set in advance; and a selector switch that switches a function operated by the plurality of color switches to a second function that selects one out of the plurality of patterns of the program control unit.

By adding a second function that uses the program control unit, it is possible to control the light emitting unit to output light with colors and timing that are difficult to output by directly operating the color switches with the fingers. By changing the operation target of the color switches using the selector switch, it is possible to use the color switches to operate the program control unit, to suppress an increase in the number of switches, and to output a variety of patterns in a range of operations that can be easily made with one hand.

The light emitting apparatus should preferably include: a fade control unit that fades in and fades out light of different colors of the light emitting unit; and a selector switch that switches a function operated by the plurality of color switches to a third function that causes the fade control unit to fade in and fade out.

By adding a third function using the fade control unit, it is possible to control the light emitting unit so as to output light with colors (gradations, multiple tones) and timing (fading) that are difficult to output by directly operating the color switches with the fingers.

The selector switch that switches the operation target function of the color switches should preferably be disposed on the grip at a position operated by the thumb or the little finger (fourth finger). By operating the selector switch with the thumb or the little finger, it is possible to easily and successively switch the function operated by the color switches. The selector switch that switches to the second function and the selector switch that switches to the third function may be shared, may be provided at a different position to the thumb and the little finger, and may be disposed so as to be aligned to enable selection at positions that can be operated by the thumb. By separately providing the selector switch that switches to the second function and the selector switch that switches to the third function, it is possible to freely and dynamically switch to the respective functions at desired timing.

The grip should preferably include a concave portion for the thumb or a concave portion for the little finger that is depressed where the thumb or the little finger is placed, and the selector switch should preferably be disposed in the concave portion for the thumb or the concave portion for the little finger.

A light emitting apparatus should preferably include an order allocation control unit inverting an allocation of orders of the plurality of color switches. By doing so, it is possible to expand the ways in which the grip can be gripped. As one example, it is possible to set the same functions to the switches operated by the same fingers even when the light emitting apparatus is moved between the left and right hands, when the up-down direction of the light emitting apparatus is changed, and when light emitting apparatuses are held in each hand. This means that even when the way in which the light emitting apparatus is held is changed, it is possible to operate the color switches using the same fingering that the user is used to.

The light emitting apparatus should preferably include an acceleration sensor detecting an operation of waving the light emitting apparatus; and a motion control unit controlling the light outputted from the light emitting unit according to the waving operation. By doing so, a new operation target (object) can be added. The function operated by such operation may be the same as the color switches, may be the same as the selector switch, or may operate a different function. The motion control unit should preferably include a brightness control unit controlling brightness of light outputted from the light emitting unit according to a brightness signal corresponding to the waving operation. It is possible for the user to dynamically change the brightness of the outputted colors in accordance with an operation of waving the light emitting apparatus.

The light emitting unit may be attached in a direction so as to extend the grip that is to a thumb side and/or a little finger side when the grip is held. In a typical example, it is possible to provide a linear-type (pen type) light emitting apparatus where the light emitting unit and the grip are connected in a straight line.

For a type where the grip is held by one hand, it is preferable for the fourth finger (little finger) side of the grip to widen so as to support the palm. Since it is possible to support the grip to stop slipping not only with the fingers but also with the palm, it becomes much easier to move the light emitting apparatus with one hand and to trace a variety of paths with the light emitting unit.

The light emitting unit may be attached to a palm and/or back of the hand side of the grip when the grip is gripped. In a typical example, it is possible to provide a parallel-type light emitting apparatus where the light emitting unit and the grip are connected in parallel. The grip should preferably be shaped like a hanging ring with an opening through which the first figure (index finger), the second finger (middle finger), the third finger (ring finger), and the fourth finger (little finger) pass and the light emitting unit is attached in parallel to the grip via the opening. By having the fingers catch on a grip shaped like a hanging ring, it is possible to prevent the light emitting apparatus from being dropped even if the grip is not tightly gripped.

The light emitting apparatus may have an overall disc shape or box shape and may include the light emitting unit disposed on an upper side and the grip disposed on a lower side, as well as an opening provided between the light emitting unit and the grip and through which the fingers pass.

The shape of the light emitting unit is not limited to a stick-like shape and may have a variety of shapes such as a semicircle, a flat plate, a cone, a heart, a polygon, or a radial shape. If the light emitting unit has a long shape like a stick, the plurality of light emitting elements should preferably be disposed so as to be distributed between a plurality of positions along a length direction of the light emitting unit so that at least three different colors are outputted individually or in a mixture at the plurality of positions.

The light emitting apparatus should preferably also include: a secondary cell housed in the grip; and a power generating unit that is housed in the grip and generates power due to the light emitting apparatus being waved and/or an associated cord or lever being driven to charge the secondary cell. Primary cells may be housed in the grip, or secondary cells and a power generating unit may be housed in the grip and the light emitting unit may be illuminated using energy produced by moving the light emitting apparatus. It is also possible to carrying out charging by moving a cord or a lever.

BRIEF DESCRIPTION OF THE DRAWINGS

FIG. 5 shows light emission states of the LED groups when color switches become on.

FIG. 7 shows light emission states of the LED groups when the selector switch is on.

DETAILED DESCRIPTION

Figure 1:
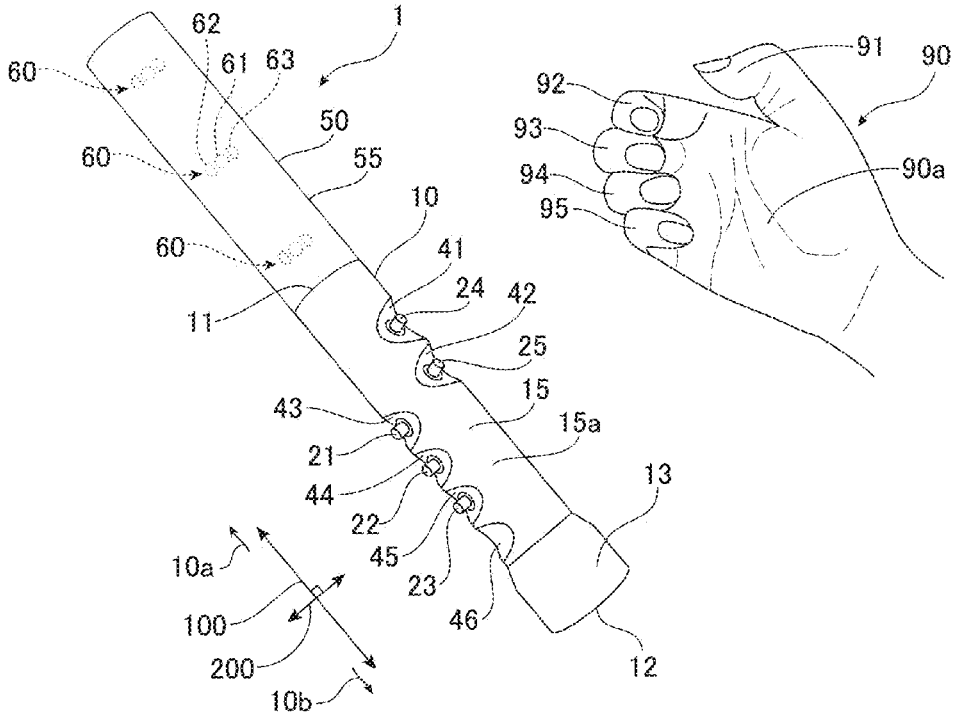
FIG. 1 shows an overview of a light emitting apparatus according to a first embodiment.

FIG. 1 shows an overview of a light emitting apparatus (light emitting device) 1 according to a first embodiment of the present invention. The light emitting apparatus 1 includes a tube-shaped grip (grip portion) 10 that is gripped or held in one hand 90, and a stick-like (tube-shaped) light emitting unit (light emitting portion, light emitter) 50 that houses three LEDs (light emitting element) groups 60 and is attached to one end (the upper end) 11 in a length direction (up-down direction) 100 of the grip 10. The three LED groups 60 each include a red LED 61, a green LED 62, and a blue LED 63 and are disposed at substantially equal intervals in the length direction 100.

The light emitting apparatus 1 includes three switches 21 to 23 attached at positions on the grip 10 that are easy to operate with the fingers. A color switch (or first color switch or R switch) 21 disposed at a position that is operated by the first finger (index finger) 92 carries out on/off control of light emission by the red LEDs 61, a color switch (or second color switch or G switch) 22 disposed at a position that is operated by the second finger (middle finger) 93 carries out on/off control of light emission by the green LEDs 62, and a color switch (or third color switch or B switch) 23 disposed at a position that is operated by the third finger (ring finger) 94 carries out on/off control of light emission by the blue LEDs 63.

The light emitting unit 50 is entirely made of an opalescent (translucent) resin and includes a tube-like cover 55 and the three LED groups 60 housed in the cover 55. The external form of the light emitting unit 50 is not limited to a tube and it is possible to attach a variety of shapes to the end 11 of the grip 10, such as a semicircle, a flat plate, a cone, a sphere, a star, or a heart. The light emitting apparatus 1 is a pen-type (or "torch type" or a "linear type") where the light emitting unit 50 and the grip 10 are connected in a straight line, and is a pen-type handy light (or "pen light" or "cheering light") that can be favorably used at concerts or the like.

The linear-type light emitting apparatus 1 is not limited to having the light emitting unit 50 attached to only the first finger (index finger) 91 side (the upper end 11) of the grip 10, and may be an apparatus with the light emitting unit 50 attached to only the fourth finger (little finger) 95 side (the lower end 12) of the grip 10 or may have the light emitting unit 50 attached to both the upper end 11 and the lower end 12 sides (i.e., both ends) of the grip 10.

The three color switches 21 to 23 are all push-button switches or switches where on and off operations are made by detecting changes in pressure, potential, or the like when depressed with the fingers. Such switches 21 to 23 are disposed at positions that can be operated by the index finger 92, the middle finger 93, and the ring finger 94 of one hand 90. In the present embodiment, the R switch 21, the G switch 22, and the B switch 23 are disposed in a line at substantially equal intervals in the length direction 100 in that order from the grip head side 10*a* to the grip end side 10*b*. When the grip 10 is gripped with the thumb 91 toward the grip head side 10*a*, the R switch 21 can be operated by the index finger 92, the G switch 22 by the middle finger 93, and the B switch 23 by the ring finger 94.

Note that the arrangement of the R switch 21, the G switch 22, and the B switch 23 is not limited to this and an arrangement where operations are also made by the fourth finger (little finger) 95 may be used. In addition, LEDs that output other colors, such as intermediate colors or white, may be disposed in the light emitting unit 50 in addition to RGB, and four switches for operating the LEDs of four colors or that include white may be disposed on the grip so as to be capable of being operated by four fingers.

The light emitting apparatus 1 includes switches 24 and 25 disposed at positions on the grip 10 that are operated by the thumb 91. The switch 24 is a switch that switches the function to be operated by the color switches 21 to 23 to a program control function and is referred to hereinafter as the "selector switch". The switch 25 is a switch that switches the function to be operated by the color switches 21 to 23 to a fade control function and is referred to hereinafter as the "fade switch". The selector switch 24 and the fade switch 25 are disposed closer to the grip head side 10*a* than the R switch 21 and are aligned in a row in the length direction 100 in that order from the grip head side 10*a* toward the grip end side 10*b* at a position that is displaced from the row of the three color switches 21 to 23.

The grip 10 includes a first thumb concave portion 41 and a second thumb concave portion 42, both parts are where the thumb 91 is placed and are depressed relative to the outer circumferential surface 15*a*. The grip 10 includes a first finger (index finger) concave portion 43, a second finger (middle finger) concave portion 44, a third finger (ring finger) concave portion 45, and a fourth finger (little finger) concave portion 46, those parts are the index finger 92, the middle finger 93, the ring finger 94, and the little finger 95 are placed respectively and are depressed relative to the outer circumferential surface 15*a*. In the present embodiment, the selector switch 24 is disposed in the first thumb concave portion 41, the fade switch 25 in the second thumb concave portion 42, the R switch 21 in the index finger concave portion 43, the G switch 22 in the middle finger concave portion 44, and the B switch 23 in the ring finger concave portion 45.

A grip end 13 on the other end 12 side of the grip 10 is slightly fatter (wider) than the part of the outer circumferential surface 15*a* gripped by the palm 90*a*. Since the palm 90*a* catches on the grip end 13, it is possible to hold the grip 10 with an appropriate force and to wave the light emitting apparatus 1 around even when the fingers that operate the switches 21 to 25 do not form a tight grip.

Figure 2:
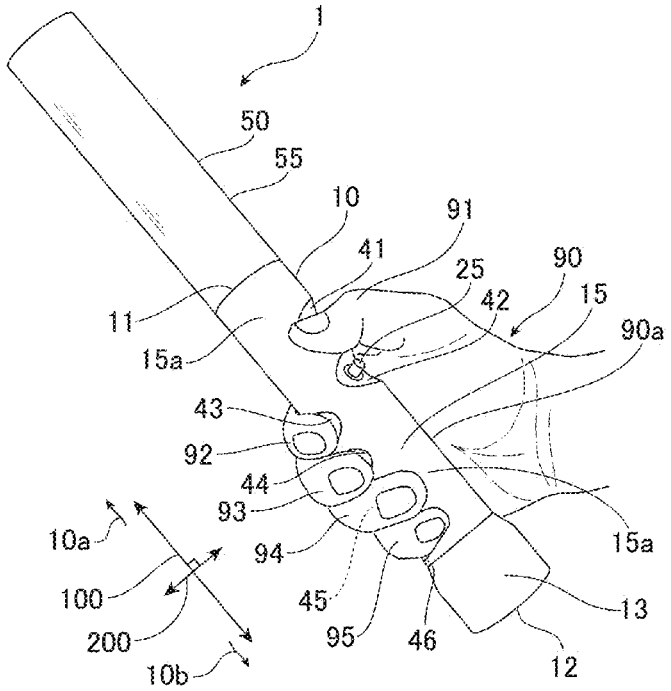
FIG. 2 shows a state where the grip of the light emitting apparatus according to the first embodiment is gripped.

FIG. 2 shows a state where the grip 10 of the light emitting apparatus 1 is being gripped. On the light emitting apparatus 1, the concave portions 41 to 46 are formed on the grip 10. It is possible to reliably hold the grip 10 by placing the fingers 91 to 95 in the respective concave portions 41 to 46. In addition, all of the switches 21 to 25 are disposed in the concave portions 41 to 45. It is easy to carry out switching operations while holding or gripping the grip 10. Also, since the selector switch 24 and the fade switch 25 are disposed slightly closer to the grip head side 10*a*, it is easy to perform switching operations with the thumb 91.

Figure 3:
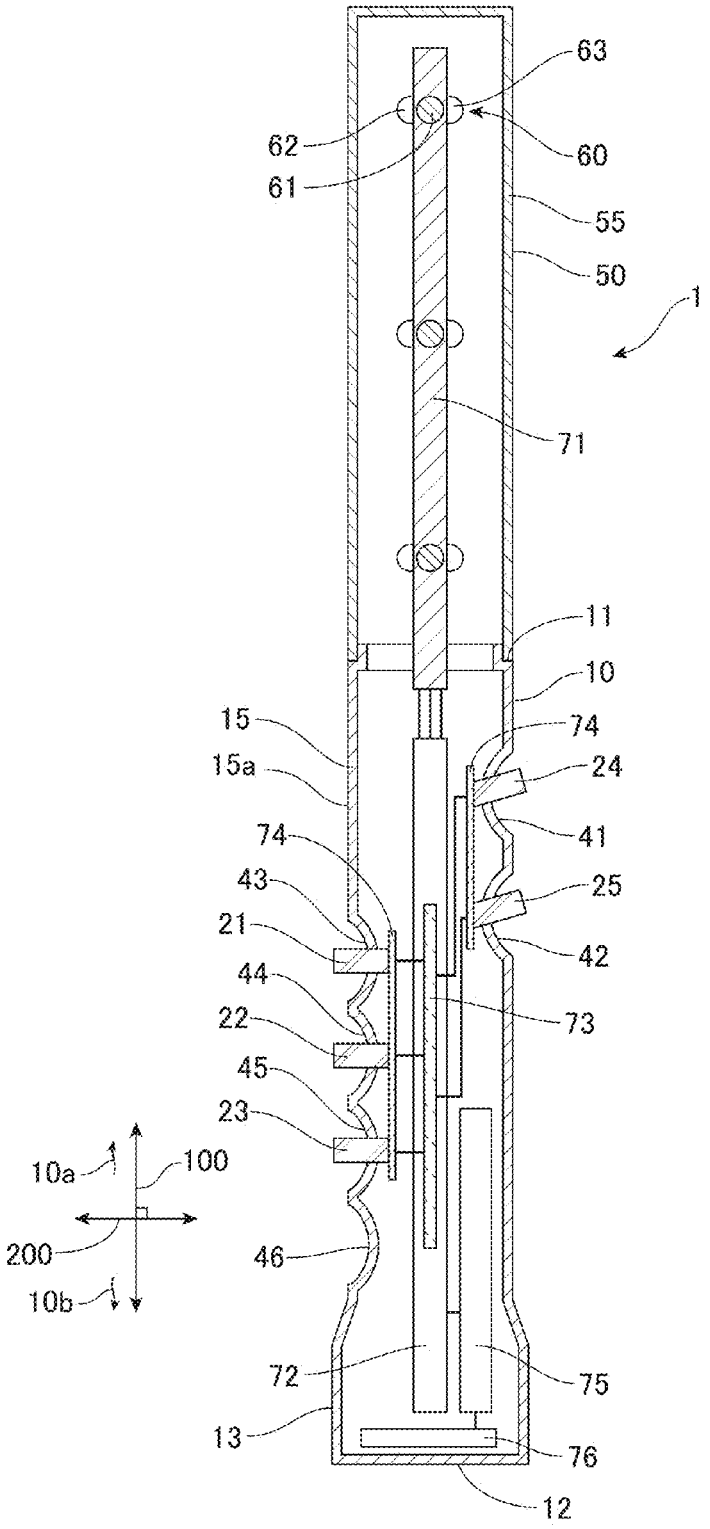
FIG. 3 is a simplified cross-sectional view of the internal structure of the light emitting apparatus according to the first embodiment.

FIG. 3 shows the internal structure of the light emitting apparatus 1 by way of a simplified cross-sectional view. The upper half of the light emitting apparatus 1 is the light emitting unit 50 and includes the cover 55 and an LED circuit board 71 on which the three LED groups 60 housed in the cover are mounted (supported) and electrically connected. The lower half of the light emitting apparatus 1 is the grip 10 and includes a housing 15 that is externally covered with a material such as resin or cloth that is easy to grip and is formed as described above in a shape that is easy to grip with the fingers. The housing 15 houses a driver circuit board 72 to which the LED circuit board 71 is electrically connected, a control unit (controller) 73 on which the driver circuit board 72 is mounted, a switching circuit board 74 for mounting all of the switches 21 to 25, a power supply (battery) box 75 that supplies power to the LEDs 61 to 63 and a power generating unit 76 that charges the cells (batteries) in the battery box.

A driver circuit that drives the LEDs 61 to 63 is mounted on the LED circuit board 71. The controller 73 includes various functions (control function units, control units) that control the emission of light by the three LED groups 60 and a function for storing light emission patterns, described later. The controller 73 typically includes a CPU and a nonvolatile memory such as a flash memory and realizes various functions by loading a program stored in the memory and settings values (a library or pattern file) into the CPU.

All of the switches 21 to 25 are mounted on the switching circuit board 74 and by controlling the controller 73 using the switches 21 to 25, the operation (function) of the light emitting unit 50 is controlled. In this light emitting apparatus 1, the switches 21 to 25 also serve as on/off switches of the power supply. That is, when any of the switches 21 to 25 is operated, the power of the light emitting apparatus 1 is switched on, and when none of the switches 21 to 25 has been operated for a certain time, the power is switched off.

The power generating unit 76 includes a mechanism that generates power by capturing waving (shaking, vibration) of the light emitting apparatus using an internal vibrator and a mechanism that generates power by having a generator (dynamo) intentionally rotated using an attached cord or lever. The power generating unit may include only one of such mechanisms. To reduce weight and/or to reduce cost, the power generating unit 76 may be omitted. By providing the power generating unit 76, it is possible to use the light emitting apparatus 1 without replacing the cells. The light emitting apparatus 1 is fundamentally used while shaking and waving so as to trace desired paths with the light emitting unit 50. Accordingly, by incorporating the power generating unit 76 and generating power with the energy present when the power generating unit 20 is shaken, it is possible to reduce power consumption of the cells and to use the light emitting unit 20 for a long time without changing the cells.

Figure 4:
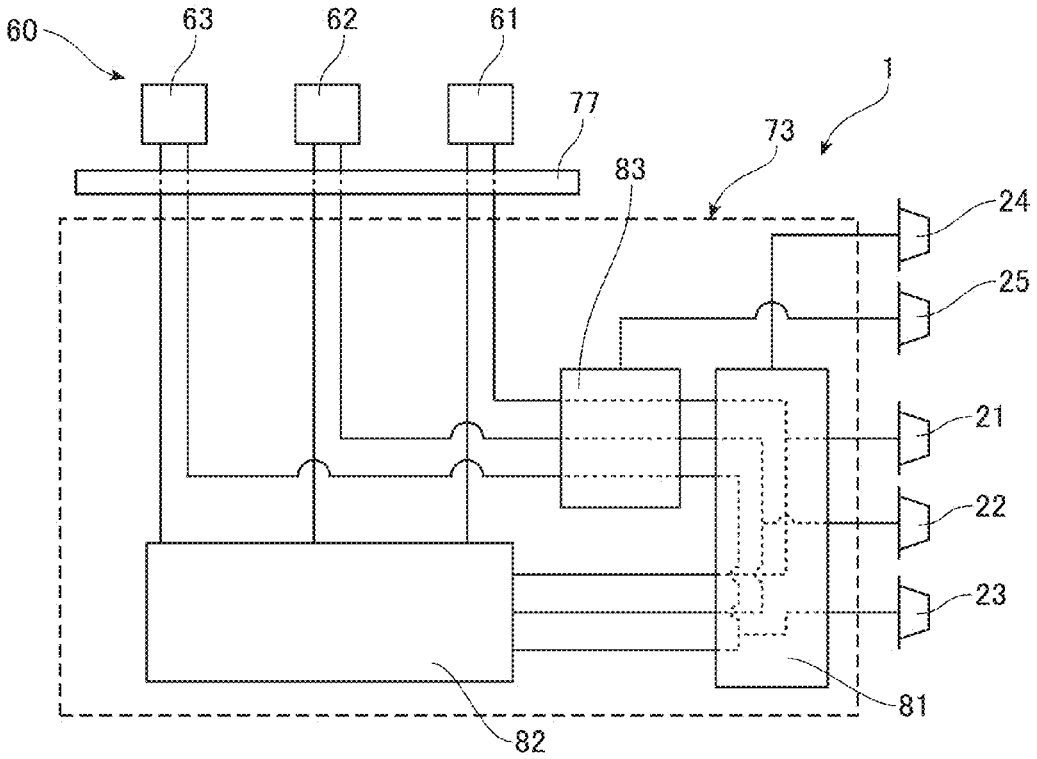
FIG. 4 shows an overview of a control unit of the light emitting apparatus according to the first embodiment.

FIG. 4 shows an overview of the controller 73 of the light emitting apparatus 1. The controller 73 according to the present embodiment includes a functional unit (selector unit) 81 that switches the functions of the three color switches 21 to 23 according to a press of the selector switch 24, a functional unit (program control unit) 82 that controls (drives) the light emission intensity and timing of the LEDs 61 to 63 in accordance with one of a plurality of light emission patterns stored in advance in a memory (not shown), and a functional unit (fade control unit) 83 that controls the light emission intensity of the LEDs 61 to 63 so as to fade in and fade out according to a press of the fade switch 25. If the controller 73 includes a CPU and is controlled by a program, such functions as the control units 81 to 83 can be carried out by executing the program.

According to a press of the selector switch 24, the selector unit 81 switches (changes) the function operated by the color switches 21 to 23 from a function (first function) that where the switches directly carry out on/off control of the respective LEDs 61 to 63 to a function (second function) that selects the pattern for having the program control unit 82 control the LEDs 61 to 63 out of patterns 31 to 37 stored in a memory. The color switches 21 to 23 may be switches that directly operate the LEDs 61 to 63 or may form a three-bit switch that operates the control unit (CPU, microcomputer) 73 that includes a function of the program control unit 82. In the light emitting apparatus 1, since the LEDs 61 to 63 are normally controlled (on/off, fade in, and fade out) via the controller 73, in the following description the color switches 21 to 23 are sometimes described as a three-bit switch.

Note that by setting, in the selector unit 81, an operation pattern (switching pattern, fingering information) where the three color switches 21 to 23 are pressed according to a predetermined procedure (conditions), for example, the pressing of predetermined switches for a predetermined time and/or a predetermined number of times, it is possible to switch the functions of the three color switches 21 to 23 in accordance with an inputted switching pattern. As examples, the color switches 21 to 23 are pressed simultaneously twice, three times, or pressed for ten seconds and then released. It may be possible to omit the selector switch 24 and to carry out switching of functions according to operations of the three color switches 21 to 23.

The program control unit 82 controls the timing and intensity of light emission by the LEDs 61 to 63 of the respective colors via the driver circuit 77 in accordance with the pattern selected by three-bit switching of the switches 21 to 23. In the present embodiment, if the selector switch 24 is not being pressed down by the thumb 91, the LEDs 61 to 63 are not driven by the program control unit 82. Conversely, if the selector switch 24 is pressed in a state where any of the switches 21 to 23 is being pressed, the LEDs 61 to 63 are controlled by the program control unit 82 and the LEDs 61 to 63 emit light according to a different pattern (the second function) to when colors are selected and switched respectively by the color switches 21 to 23.

The fade control unit 83 includes a function that fades in light emission by the LEDs 61 to 63 of the colors selected by the color switches 21 to 23 and fade outs light emission of illuminated LEDs 61 to 63 if such LEDs 61 to 63 cease to be selected by the color switches 21 to 23. The fade switch 25 switches on the fade control unit 83, and changes the first function where the LEDs 61 to 63 are directly switched on and off (for pulsed emission) to a third function where the brightness of the LEDs 61 to 63 is gradually increased (fade in) or is gradually decreased (fade out). As one example, if the fade switch 25 is pressed and one of the color switches 21 to 23 is pressed, the corresponding LEDs 61 to 63 fade in and if the fade switch 25 is then released while fading in, the LEDs 61 to 63 emit light in a pulsed manner. This is the same for a fade out, so that by operating the fade switch 25, it is possible to instantaneously changeover between fade in and fade out control of the LEDs 61 to 63 and control that on and off the LEDs 61 to 63 in a pulsed manner.

First, in the light emitting apparatus 1, in a state where the selector switch 24 is off (a state where the switch 24 is not pressed), when one or a plurality of the R switch 21, the G switch 22, and the B switch 23 is/are pressed, the LEDs 61 to 63 of the color(s) corresponding to the respective switches 21 to 23 emit light. By emitting light of the three colors red R, green G, and blue B separately or as a mixture, light of a desired color is produced (expressed) at desired timing in a variety of spaces such as at a concert (that is the first function).

Next, when one or a plurality of the color switches 21 to 23 is/are set at on (i.e., is/are pressed) in a state where the fade switch 25 is on (pressed), the light emission intensity (brightness) of the LEDs 61 to 63 corresponding to the respective switches 21 to 23 gradually increases and by gradually increasing the intensity of the color of such LEDs 61 to 63, the color of the light outputted from the light emitting unit 50 gradually changes in a gradation. It is possible to produce intermediate colors for the LEDs 61 to 63 using the fade control unit 83. When one or a plurality of the color switches 21 to 23 is/are set at off when the fade switch 25 is on, the light emission intensity (brightness) of the LEDs 61 to 63 corresponding to the respective switches 21 to 23 gradually decreases and by gradually decreasing the intensity of the color of such LEDs 61 to 63, it is possible to gradually change the color of the light outputted from the light emitting unit 50 in a gradation (that is the third function).

Figure 5:
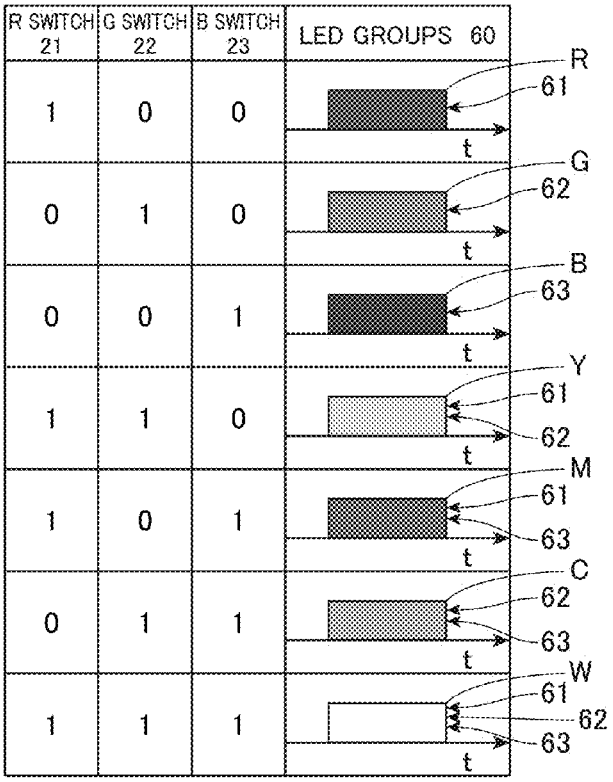

FIG. 5 shows the light emission state of the LED groups 60 when at least one of the three color switches 21 to 23 becomes on. If the R switch 21 is set at on in a state where the selector switch 24 is off (i.e., the index finger 92 is pressed but the middle finger 93 and the ring finger 94 are released), the red LEDs 61 emit light so that light of the color red R is outputted. In the same way, if the G switch 22 is set at on (i.e., the middle finger 93 is pressed but the index finger 92 and the ring finger 94 are released), the green LEDs 62 emit light, resulting in the color green G being outputted, and if the B switch 23 is set at on (i.e., the index finger 92 and the middle finger 93 are released but the ring finger 94 is pressed), the blue LEDs 63 emit light, resulting in the color blue B being outputted. If all of the switches 21 to 23 are set at off (the index finger 92, the middle finger 93, and the ring finger 94 are all released), light is not emitted.

When the R switch 21 and the G switch 22 are set at on (the index finger 92 and the middle finger 93 are pressed but the ring finger 94 is released), the red LEDs 61 and the green LEDs 62 emit light, resulting in yellow Y light being outputted, if the R switch 21 and the B switch 23 are set at on (the index finger 92 and the ring finger 94 are pressed but the middle finger 93 is released), the red LEDs 61 and the blue LEDs 63 emit light, resulting in magenta (reddish purple) M light being outputted, if the G switch 22 and the B switch 23 are set at on (the middle finger 93 and the ring finger 94 are pressed but the index finger 92 is released), the green LEDs 62 and the blue LEDs 63 emit light, resulting in cyan (sky blue) C light being outputted, and if all of the switches 21 to 23 are set at on (the index finger 92, the middle finger 93 and the ring finger 94 are pressed), the red LEDs 61, green LEDs 62 and the blue LEDs 63 emit light, resulting in white W light being outputted.

Accordingly, the light emitting apparatus 1 is capable of outputting light of a desired color by using predetermined fingers (fingering, switching) in the same way as when the strings of a guitar are pressed so as to produce a predetermined chord or when the pistons (piston valves) of a trumpet are pressed so as to produce a tone. This means that when the user becomes used to the fingering that operates the color switches 21 to 23, it is possible for the user to intuitively match fingering to colors and to control the light emitting apparatus 1 to produce colors in the manner of a musical instrument that produces light with the same feeling as when operating (playing) a genuine musical instrument. In addition, by operating the selector switch 24 and the fade switch 25, it is possible to further increase the colors and patterns of light that can be emitted from the light emitting unit 50.

In addition, since the light emitting apparatus 1 is capable of outputting light of various colors according to the fingering of the fingers while the grip 10 is being gripped by the single hand 90, it is possible to perform operations while moving the light emitting apparatus 1, thereby enabling various arrangements where paths are traced with light of various colors. Accordingly, by using the light emitting apparatus 1, it is possible to draw in a space (perform) using light of various colors. In addition, while holding the grip 10 of the light emitting apparatus 1 with one hand 90, it is possible to do other things with the other hand, making it possible to hold and perform actions with a light emitting apparatus 1 in each hand.

Figure 6:
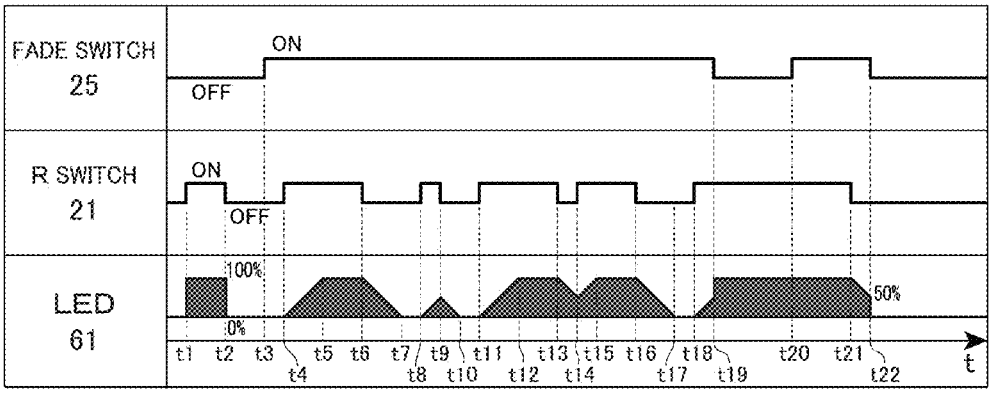
FIG. 6 shows light emission states of the LED groups during on/off switching of the fade switch and the color switches.

FIG. 6 is a timing chart showing the light emission state of the red LEDs 61 when the fade switch 25 is pressed and the R switch 21 is switched on and off. Note that the light emitting state of the LEDs 62 and 63 of the other colors are the same when the other switches 22 and 23 are switched on and off, and instead of single colors being switched on and off, the light emission brightness and color gradually change due to fading in and fading out in a state where a plurality of the LEDs 61 to 63 are illuminated.

At time t1, if the R switch 21 becomes on in a state where the fade switch 25 is off, the red LEDs 61 immediately emit light with a brightness of 100%. At time t2, if the R switch 21 becomes off, the brightness of the red LEDs 61 becomes 0% and the red LEDs 61 immediately stop emitting light.

If, at time t3, the fade switch 25 becomes on and at time t4 the R switch 21 becomes on, the red LEDs 61 gradually fade in from a brightness of 0% to reach a brightness of 100% at time t5. If, at time t6, the R switch 21 becomes off, the red LEDs 61 fade out from a brightness of 100% to reach a brightness of 0% and stop emitting light at time t7.

If, at time t8, the R switch 21 becomes on in a state where the fade switch 25 is on, the red LEDs 61 fade in from a brightness of 0%. If, at a time t9 where the brightness is around 50%, the R switch 21 becomes off, the red LEDs 61 fade out before a brightness of 100% is reached and reach a brightness of 0% and stop emitting light at time t10.

If, at time t11, the R switch 21 becomes on in a state where the fade switch 25 is on, the red LEDs 61 fade in from a brightness of 0% to reach a brightness of 100% at time t12. If, at time t13, the R switch 21 becomes off, the red LEDs 61 fade out from a brightness of 100%. If, at a time t14 where the brightness is around 50%, the R switch 21 becomes on, the red LEDs 61 fade in before a brightness of 0% is reached and reach a brightness of 100% at time t15. If, at time t16, the R switch 21 becomes off, the red LEDs 61 gradually fade out from a brightness of 100% to reach a brightness of 0% and stop emitting light at time t17.

If, at time t18, the R switch 21 becomes on in a state where the fade switch 25 is on, the red LEDs 61 fade in from a brightness of 0%. If, at a time t19 where the brightness is around 50%, the fade switch 25 becomes off, the red LEDs 61 immediately emit light with a brightness of 100%. That is, the function of the color switch 21 dynamically changes from fade control (the third function) to on/off control (the first function). At time t20, the fade switch 25 is switched on and if, at time t21, the R switch 21 becomes off in a state where the fade switch 25 is on, the red LEDs 61 gradually fade out from a brightness of 100%. If, at a time t22 where the brightness is around 50%, the fade switch 25 becomes off, the brightness of the red LEDs 61 becomes 0% so that the emission of light is immediately stopped.

Figure 7:
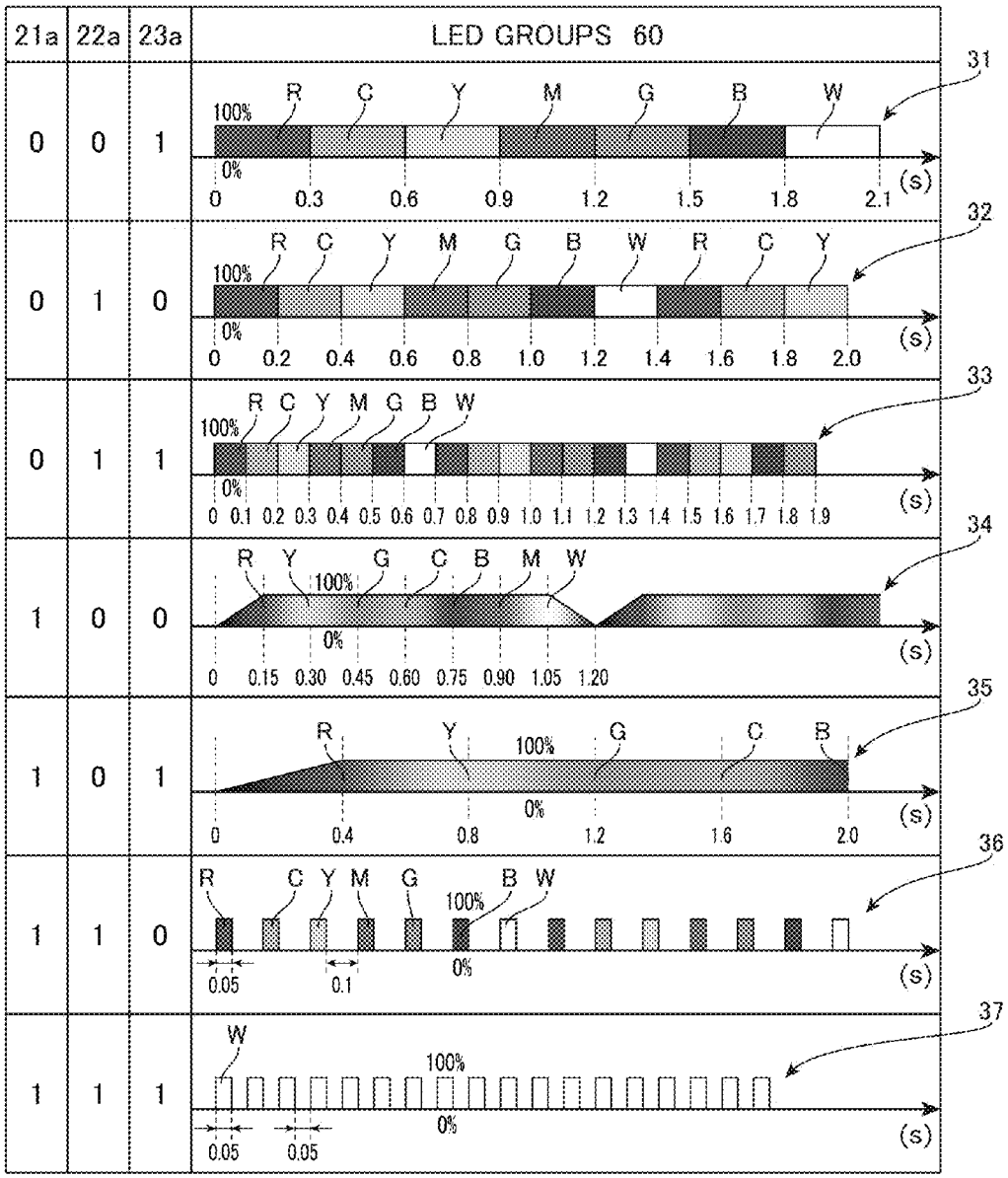

FIG. 7 shows light emission states (light emission patterns) of the LED groups 60 when the selector switch 24 is on. A first light emission pattern 31 is selected when the RGB switches 21 to 23 are respectively off, off, and on, that is, when the RGB switches 21 to 23 are selected as (0,0,1) (a state where the index finger 92 and the middle finger 93 are released and the switch 23 is pressed with the ring finger 94). The first light emission pattern 31 is capable of consecutively producing colors with a brightness of 100% in the order of red R, cyan C, yellow Y, magenta M, green G, blue B, and white W with intervals of 0.3 seconds.

A second light emission pattern 32 is selected when the RGB switches 21 to 23 are selected as (0,1,0) (a state where the index finger 92 and the ring finger 94 are released and the switch 22 is pressed with the middle finger 93). The difference with the first light emission pattern 31 is that the emission of light (on/off) of the respective colors is carried out at 0.2 second intervals. A third light emission pattern 33 is selected when the RGB switches 21 to 23 are selected as (0,1,1) (a state where the index finger 92 is released and the switches 22 and 23 are pressed with the middle finger 93 and the ring finger 94). The difference with the first light emission pattern 31 is that the emission of light of the respective colors is carried out at 0.1 second intervals.

A fourth light emission pattern 34 is selected when the RGB switches 21 to 23 are selected as (1,0,0) (a state where the switch 21 is pressed with the index finger 92 and the middle finger 93 and the ring finger 94 are released). The fourth light emission pattern 34 is capable of producing color gradations by repeatedly fading in and fading out the respective colors of red R, yellow Y, green G, cyan C, blue B, magenta M, and white W in that order with intervals of 0.15 seconds.

A fifth light emission pattern 35 is selected when the RGB switches 21 to 23 are selected as (1,0,1) (a state where the switches 21 and 23 are pressed by the index finger 92 and the ring finger 94 and the middle finger 93 is released). The difference with the fourth light emission pattern 34 is that the color gradations are produced with the respective colors at 0.4-second intervals.

A sixth light emission pattern 36 is selected when the RGB switches 21 to 23 are selected as (1,1,0) (a state where the switches 21 and 22 are pressed with the index finger 92 and the middle finger 93 and the ring finger 94 is released). The sixth light emission pattern 36 is capable of consecutively producing (flashing) light of the respective colors of red R, cyan C, yellow Y, magenta M, green G, blue B, and white W in that order for 0.05 seconds at a time with intervals of 0.1 seconds.

A seventh light emission pattern is selected when the RGB switches 21 to 23 are selected as (1,1,1) (a state where the switches 21, 22, and 23 are pressed with the index finger 92, the middle finger 93 and the ring finger 94). The seventh light emission pattern 37 consecutively emits (flashes) white light with a brightness of 100% for 0.05 seconds at a time with intervals of 0.05 seconds. Note that the present embodiment is not limited to the seven light emission patterns 31 to 37 and it is possible to store a variety of light emission patterns in advance in a memory (not shown).

Figure 8:
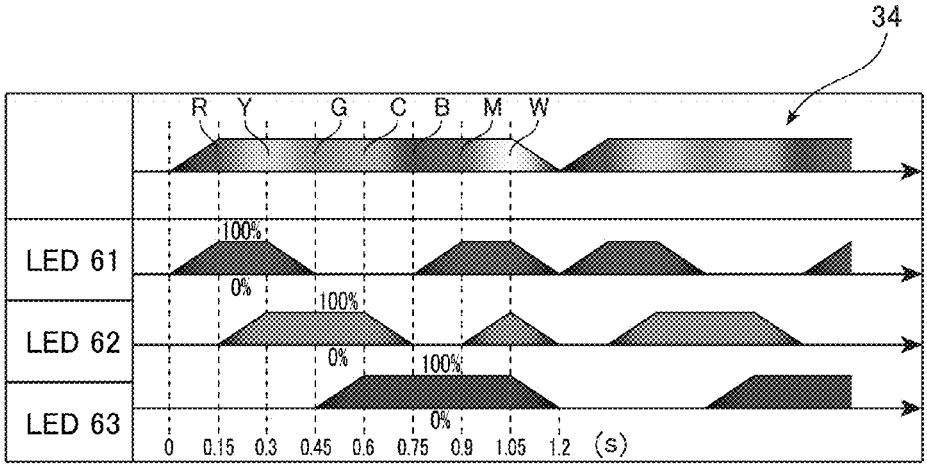
FIG. 8 shows a fourth light emission pattern broken down into the respective colors red, green, and blue.

FIG. 8 shows the fourth light emission pattern 34 broken down into the colors red R, green G, and blue B. The red LEDs 61 gradually fade in from a brightness of 0% to 100% during the 0 to 0.15 s period, emit light with a brightness of 100% during the 0.15 to 0.30 s period, gradually fade out from a brightness of 100% to 0% during the 0.30 to 0.45 s period, are off with a brightness of 0% during the 0.45 to 0.75 s period, gradually fade in from a brightness of 0% to 100% during the 0.75 to 0.90 s period, emit light with a brightness of 100% during the 0.90 to 1.05 s period, and gradually fade out from a brightness of 100% to 0% during the 1.05 to 1.20 s period, and repeat the above from the 1.20 s point onward.

The green LEDs 62 are off with a brightness of 0% during the 0 to 0.15 s period, gradually fade in from a brightness of 0% to 100% during the 0.15 s to 0.30 s period, emit light with a brightness of 100% during the 0.30 to 0.60 s period, gradually fade out from a brightness of 100% to 0% during the 0.60 to 0.75 s period, are off with a brightness of 0% during the 0.75 to 0.90 s period, gradually fade in from a brightness of 0% to 100% during the 0.90 to 1.05 s period, and gradually fade out from a brightness of 100% to 0% during the 1.05 to 1.20 s period, and repeat the above from the 1.20 s point onward.

The blue LEDs 63 are off with a brightness of 0% during the 0 to 0.45 s period, gradually fade in from a brightness of 0% to 100% during the 0.45 s to 0.60 s period, emit light with a brightness of 100% during the 0.60 to 1.05 s period, and gradually fade out from a brightness of 100% to 0% during the 1.05 to 1.20 s period, and repeat the above from the 1.20 s point onward.

By the patterns above, in the fourth light emission pattern 34, red R is emitted at 0.15 s, yellow Y which is a combination of red R and green G is emitted at 0.30 s, green G is emitted at 0.45 s, cyan C which is a combination of green G and blue B is emitted at 0.60 s, blue B is emitted at 0.75 c, magenta M which is a combination of red R and blue B is emitted at 0.90 s, and white W which is a combination of red R, green G, and blue B is emitted at 1.05 s, resulting in a gradation display of seven colors at 0.15 s intervals being produced.

Figure 9:
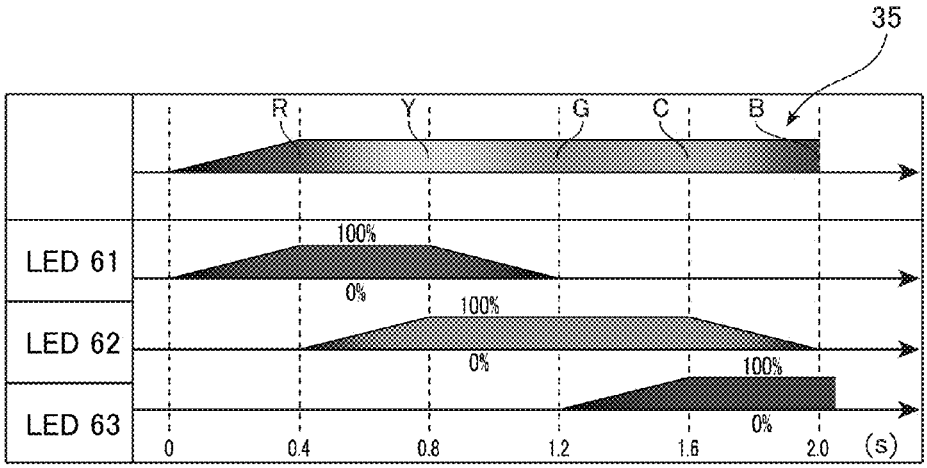
FIG. 9 shows a fifth light emission pattern broken down into the respective colors red, green, and blue.

FIG. 9 shows the fifth light emission pattern 35 broken down into the colors red R, green G, and blue B. In the same way as the fourth light emission pattern 34, the fifth light emission pattern 35 produces a gradation display of seven colors at 0.4 s intervals.

In the light emitting apparatus 1, a process that changeovers the function of the color switches 21 to 23 between an on/off function (the first function) and a pattern selection function for the program control unit 82 (the second function) is carried out according to on/off control of the selector switch 24 with the thumb 91. With the same fingering, by merely switching the selector switch 24 using the thumb 91, it is possible to dynamically switch the pattern of light outputted from the light emitting unit 50. As one example, if the selector switch 24 is operated by the thumb 91 in a state where the index finger 92 and the middle finger 93 are released and the color switch 23 is pressed with the ring finger 94, the light emission state of the light emitting unit 50 can be switched between continuous illumination of blue B to the first light emission pattern 31.

In this way, the user can perform various actions while holding the light emitting apparatus 1 with one hand 90 and can operate the switches 21 to 25 with the one hand 90 to freely control the pattern (color, timing of flashing, changes over time, and the like) of light outputted from the light emitting unit 50 according to using different fingerings (arrangements of the fingers or patterns of the fingers). The user can output a variety of light patterns on a variety of paths, and can freely display light at a variety of locations, such as on stage, when watching as a spectator, indoors, and outdoors. In addition, it is also possible to provide a function of locking the light emission state of the light emitting unit 50.

Figure 10:
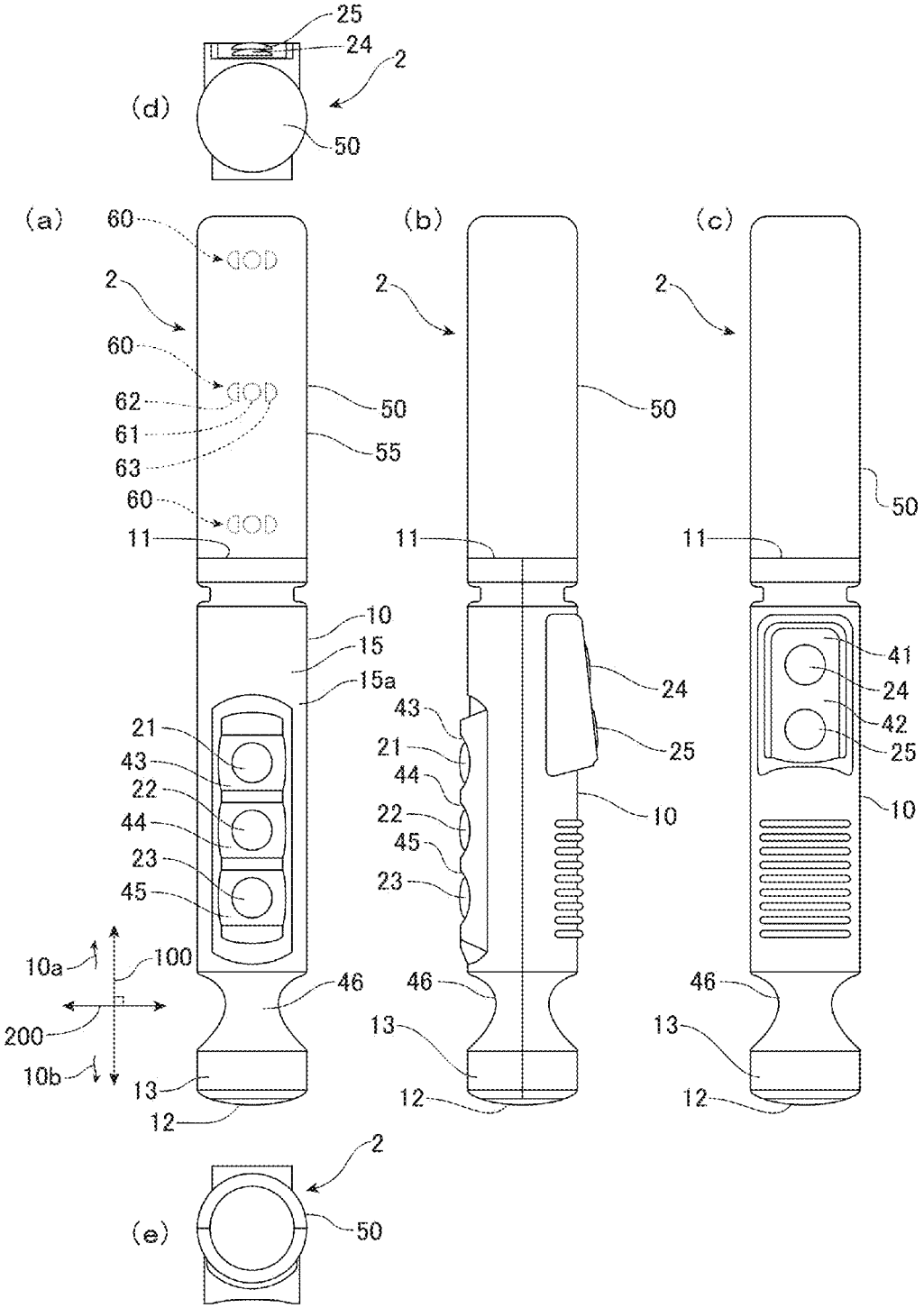
FIG. 10 shows a light emitting apparatus according to a second embodiment from various directions, with (a) a front view, (b) a right side view, (c) a rear view, (d) a plan view looking from above, and (e) a bottom view looking from below.

FIGS. 10(*a*) to (*e*) show a light emitting apparatus 2 according to a second embodiment of the present invention from various directions. Note that a left side view and right side view where the light emitting apparatus 2 is viewed from the left and right are symmetric. This light emitting apparatus 2 is also a pen-type light and includes the tube-like grip 10 that is gripped in one hand 90 and a tube-like light emitting unit 50 housing the three LED groups 60 that is attached to the upper end 11 in the length direction 100 of the grip 10, with the light emitting unit 50 and the grip 10 being connected in a straight line. Note that parts that are the same as the above embodiment have been assigned the same reference numerals and description thereof is omitted. This also applies to the following description.

In the light emitting apparatus 2, a fourth finger (little finger) concave portion 46 is depressed around the entire circumference of the outer circumferential surface 15*a* of the grip 10. By placing the little finger 95 around the little finger concave portion 46, it is possible to hold the grip 10 much more easily and stably. In addition, since the little finger 95 can be supported by the little finger concave portion 46 when the light emitting apparatus 2 is waved around, it is possible to prevent the grip 10 from slipping.

Figure 11:
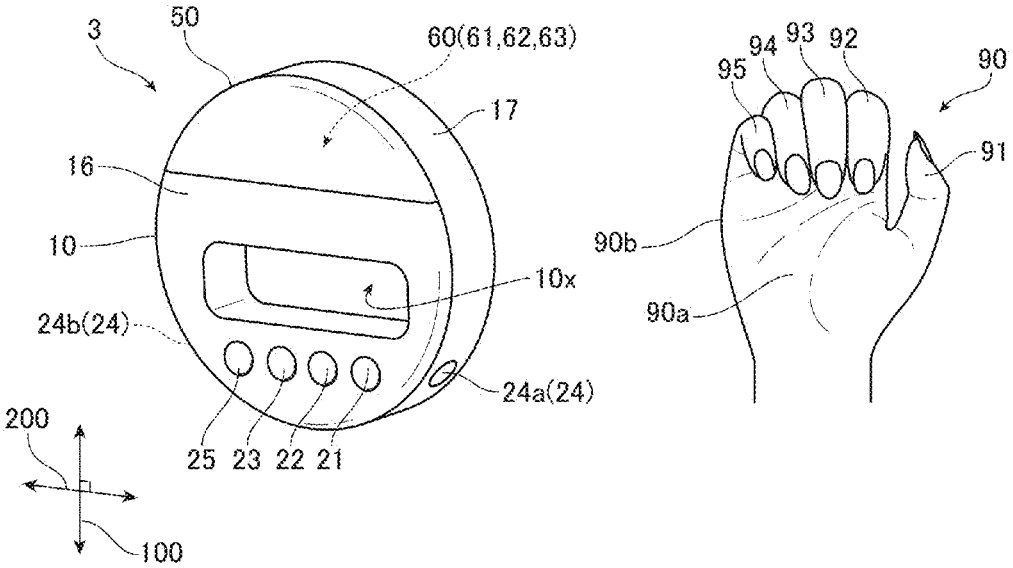
FIG. 11 shows an overview of a light emitting apparatus according to a third embodiment.
Figure 12:
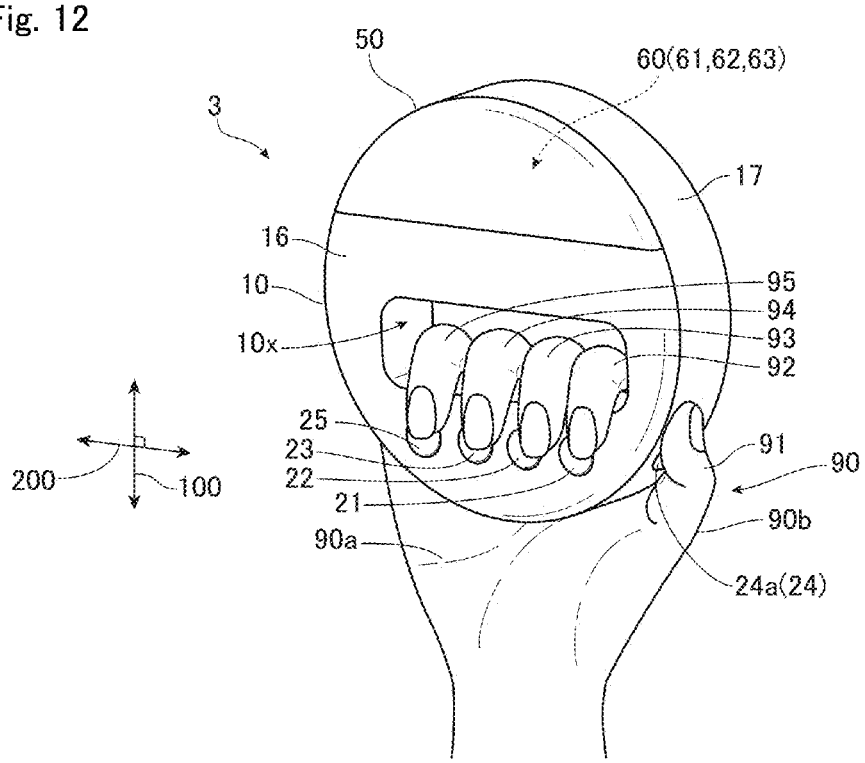
FIG. 12 shows a state where the grip of the light emitting apparatus according to the third embodiment is held.
Figure 13:
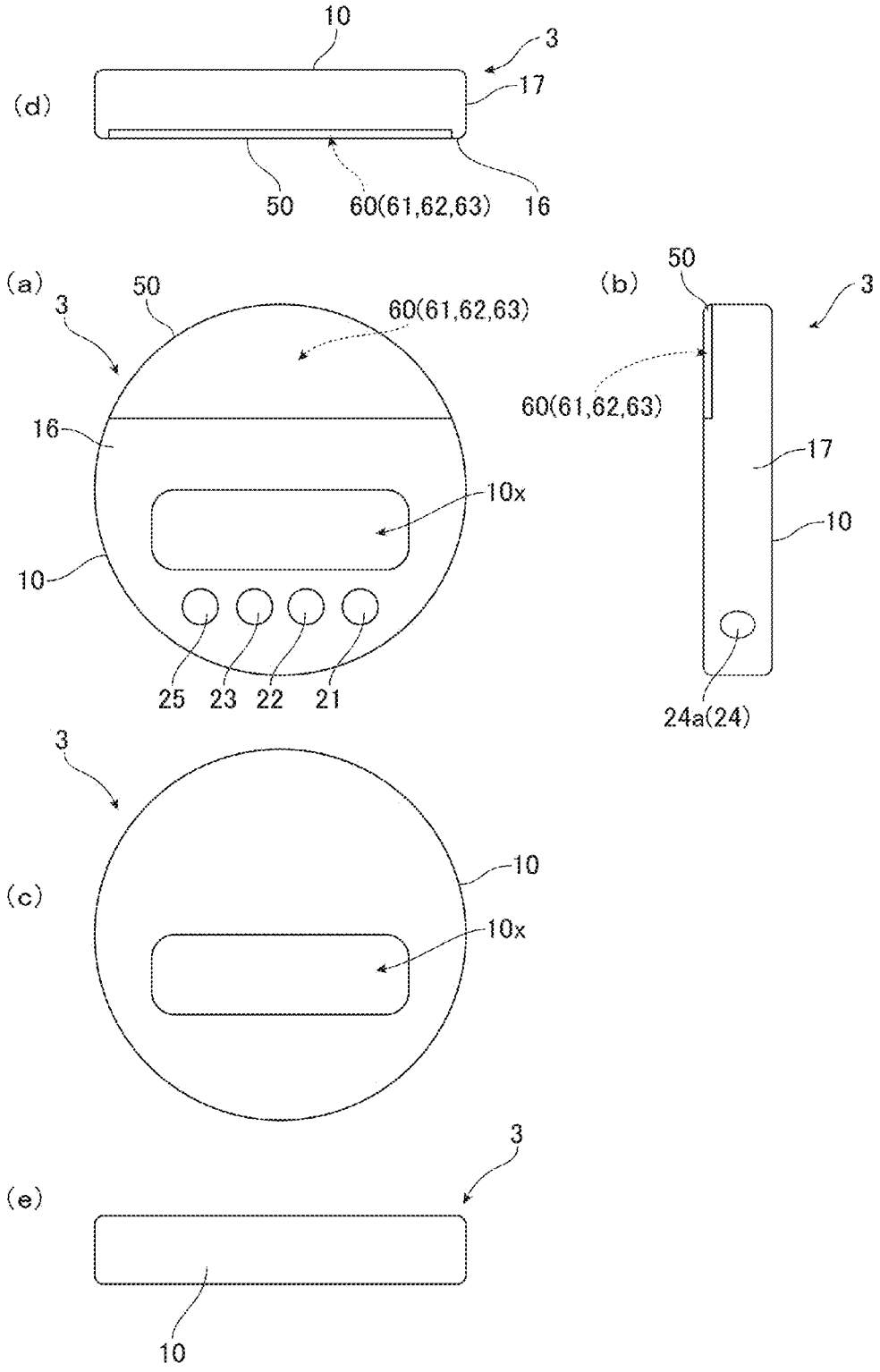
FIG. 13 shows a light emitting apparatus according to the third embodiment from various directions, with (a) a front view, (b) a right side view, (c) a rear view, (d) a plan view looking from above, and (e) a bottom view looking from below.

FIG. 11 shows an overview of a light emitting apparatus 3 according to a third embodiment of the present invention. FIG. 12 shows a state where the grip 10 of the light emitting apparatus 3 is being gripped. FIGS. 13(*a*) to (*e*) show the light emitting apparatus 3 from various directions. Note that a left side view and right side view where the light emitting apparatus 3 is viewed from the left and right are symmetric.

The light emitting apparatus 3 is in an overall disc shape and includes the grip 10 in the form of a hanging ring (hanging strap (on a bus or train)) provided with a space (opening) 10*x* through which the first finger (index finger) 92, the second finger (middle finger) 93, the third finger (ring finger) 94, and the fourth finger (little finger) 95 can pass in substantially the center and the half-moon shaped light emitting unit 50 in which LEDs capable of full color emission are housed and which is attached to a back of the hand 90*b* side of the grip 10 so as to be flush with a surface 16 of the grip 10 at a position of the upper third of the surface 16. The light emitting apparatus 3 is a ring-shaped (parallel type) handy light where the light emitting unit 50 and the grip 10 are connected in parallel via the space 10*x* through which the fingers pass. Since the grip 10 includes the space 10*x* through which the hand can pass in the same way as a hanging strap, since the fingers catch on the opening 10*x* even when the grip 10 is not gripped, it is possible to prevent the light emitting apparatus 3 from being dropped.

Other examples of a parallel-type light emitting apparatus 3 are not limited to having the light emitting unit 50 attached to the back of the hand 90*b* side of the grip 10 and may have the light emitting unit 50 attached to the palm of the hand 90*a* side of the grip 10 or may have the light emitting unit 50 attached to both the back of the hand 90*b* and the palm of the hand 90*a* sides of the grip 10.

This light emitting apparatus 3 includes the switches 21 to 25 attached at positions that are easy to operate with the fingers when the grip 10 is gripped in the same way as a hanging strap. The switches 21 to 23 and 25 are disposed so as to be aligned in a row with substantially equal intervals in the left-right direction 200 on the surface 16 of the grip 10, with the R switch 21 disposed at a position operated by the index finger 92, the G switch 22 disposed at a position operated by the middle finger 93, the B switch 23 disposed at a position operated by the ring finger 94, and the fade switch 25 disposed at a position operated by the little finger 95. The selector switch 24 is disposed as a left-right pair on the side surface 17 of the grip 10 with the selector switch 24*a* on the right side at a position operated by the thumb 91 of the right hand 90 when the index finger 92, the middle finger 93, the ring finger 94, and the little finger 95 have been passed through the opening 10*x* and the selector switch 24*b* on the left side at a position operated by the thumb 91 of the left hand (not shown) when the left hand has been passed through the opening 10*x*.

Figure 14:
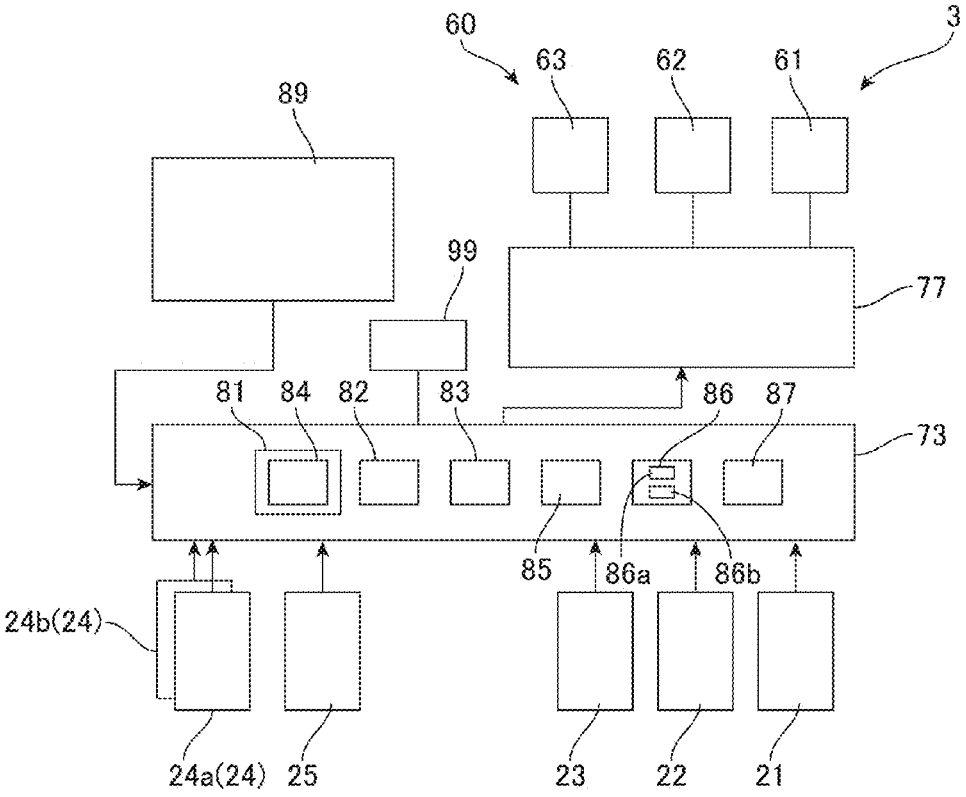
FIG. 14 shows an overview of a control unit of the light emitting apparatus according to the third embodiment.

FIG. 14 shows an overview of the controller 73 of the light emitting apparatus 3. The controller 73 includes a selector unit 81 that switches the functions respectively assigned to the color switches 21 to 23 and/or the fade switch 25. The selector unit 81 includes a switching pattern that changeovers the functions assigned to the switches 21 to 23 and 25 when the switches 21 to 25 are operated according to a predetermined procedure (algorithm) stored in advance in a memory 99.

The controller 73 further includes the program control unit 82 that controls the light emission pattern of the LEDs 61 to 63, the fade control unit 83 that controls the light emission intensity of the LEDs 61 to 63, an order allocation control unit (switching functions inverting unit) 84 that controls the allocation of orders of the switches 21 to 23 and 25, a preset unit (color setting unit) 85 that allows the user to adjust the colors made by the LEDs 61 to 63 and store such adjustments, a motion control unit (motion light control unit) 86 that controls the output of the LEDs 61 to 63 in accordance with a waving or moving operation or motion of the light emitting apparatus 3, and a self-hold unit 87 that stores a light emission state of the LEDs 61 to 63.

The selector unit 81 switches, according to one press of the selector switch 24 (the first switching pattern), a function (the function provided by the controller 73) operated by the color switches 21 to 23 from the first function (on/off control function) that carries out on/off control of the LEDs 61 to 63 to the second function (pattern selection function) where the program control unit 82 selects a pattern for controlling the LEDs 61 to 63 out of the patterns 31 to 37 stored in the memory 99. When the selector switch 24 is pressed again, there is a switch from the second function to the first function.

The selector unit 81 switches, according to one press of the fade switch 25 (the second switching pattern), a function operated by the color switches 21 to 23 from the first function that carries out pulsed on/off control of the LEDs 61 to 63 to the third function (fade function) where the fade control unit 83 fades in and fades out the brightness (light emission intensity) of the LEDs 61 to 63. If the fade switch 25 is pressed again, there is a switch from the third function to the first function.

The selector unit 81 also includes a function as the order allocation control unit 84. The order allocation control unit 84 inverts the allocation of the order (functions) operated by the color switches 21 to 23 and the fade switch 25 in the left-right direction whenever all of the switches 21 to 25 are simultaneously pressed for two seconds (a third switching pattern). The function assigned or allocated to the switch 21 that is on/off control of the red LEDs 61 when operated by the index finger 92 of the right hand 90 before inverting switching functions, is changed to the function of as the fade switch 25 that is operated by the little finger of the left hand (not shown) after inverting the switching functions. In the same way, the function of on/off control of the green LEDs 62 that was assigned to the G switch 22 operated by the middle finger 93 of the right hand 90 before inverting switching functions to the function of on/off control of the blue LEDs 63 that is operated by the ring finger of the left hand after inverting, and the function of on/off control of the blue LEDs 63 that was assigned to the B switch 23 operated by the ring finger 94 of the right hand 90 before inverting switching functions to the function of on/off control of the green LEDs 62 that is operated by the middle finger of the left hand after inverting. Also, the function of the fade switch 25 that is operated by the little finger 95 of the right hand 90 before inverting switching functions to the function of on/off control of the red LEDs 61 operated by the index finger 92 of the left hand after inverting. Also, the selector switch 24 is provided on both the left and right sides of the side surface 17 of the grip 10, with the right selector switch 24*a* being operated by the thumb 91 of the right hand 90 before inverting and the left selector switch 24*b* being operated by the thumb of the left hand after inverting.

In this way, the switching functions inverting unit 84 changeovers the respective functions of the switches 21 to 23, and 25 operated by the right hand 90 to functions operated by the left hand. This means that even if the light emitting apparatus 3 is passed between the left and right hands or a light emitting apparatus 3 is held in each hand, it is unnecessary to change the fingers that operate the switches 21 to 23 and 25 and it is possible to operate the color switches 21 to 23 and the fade switch 25 with the same fingering (switching) on both hands. It is not necessary to provide separate light emitting apparatuses 3 for the left hand and the right hand and it is possible to switch the same light emitting apparatus 3 between right hand mode and left hand mode. It is possible to provide the light emitting apparatus 3 that is economical, allows the user to freely choose which hand will hold the light emitting apparatus 3, and is easy to use.

In addition, by repeating an operation of simultaneously pressing all of the switches 21 to 25 for two seconds twice (a fourth switching pattern), the selector unit 81 changes the functions operated by the color switches 21 to 23 and the fade switch 25 (the function provided by the controller 73) to the preset function (preset unit) 85. The preset unit 85 enables the user to adjust the colors made by the LEDs 61 to 63 and store the adjustment (a fifth function, preset function). The preset unit 85 first assigns color switches 21 to 23 a function of changing the light emission intensity of the LEDs 61 to 63 between eight levels (tone control function). Whenever the color switches 21 to 23 become on, the light emission intensities of the respective LEDs 61 to 63 change from a brightness of 0% on eight levels that for example are brightnesses of 15%, 30%, 45%, 60%, 75%, 90%, and 100%, return to a brightness of 0% on reaching a brightness of 100%, and then repeat the same changes. By changing the LEDs 61 to 63 of the three colors on eight levels, the user can produce (adjust, combine) a desired color out of 512 colors.

The preset unit 85 assigns the fade switch 25 as a switch that changes the functions of the switches 21 to 23 between a tone control function and a preset function. That is, when color generation by the user through tone control using the color switches 21 to 23 ends, by pressing the fade switch 25, the user switches the functions of the switches 21 to 23 to the preset function. During the preset function, the color switches 21 to 23 become a three-bit switch and the color generated by the user is recorded in the memory 99 in association with one of seven values that are (1(on), 0(off), 0(off), (0,1,0), (0,0,1), (1,1,0), (1,0,1), (0,1,1), and (1,1,1). As one example, by continuously inputting a desired value for a predetermined time (for example, two seconds) using the switches 21 to 23 in a state where the fade switch 25 is pressed, the registration of the color generated by the user is completed. The color recorded (registered) in the memory 99 can be selected by the program control unit 82 and can be outputted by the user at any time using such light emitting apparatus 3.

The tone information of the color generated using the preset unit 85 can be easily transmitted using a short and simple expression such as R0G3B2 (the 0 level of the R switch 21, the 3 level of the G switch 22, and the 2 level of the B switch 23) by posting onto a bulletin board service on the Internet or the like. This means that at a concert or the like, it is possible to share color information for planned light emission in advance with other users, which enables to carry out a joint or collaboration performance with other users using a light emitting apparatus 3.

If, after all of the switches 21 to 25 have been pressed a first time, there has been no second pressing of all of the switches within a predetermined time (for example, within 10 seconds), the selector unit 81 does not change to the preset unit 85. Since the generation of color is carried out in the preset unit 85, the inverting of switching functions dose not carried out even if the pressing of all buttons continues. If, after the selector unit 85 has switched to the preset unit 85, the next operation has not been made within a predetermined time (for example, within 30 seconds), the preset unit 85 ends and there is a return to the function that was set beforehand or fundamentally to the first function.

When all of the switches 21 to 25 are simultaneously pressed for two seconds repeatedly three times (a fifth switching pattern), the selector unit 81 changes the function of the motion light control unit 86 on and off. The motion light control unit 86 controls the output of the LEDs 61 to 63 in accordance with a motion where the user waves or moves the light emitting apparatus 3 (the sixth function, motion control function). The light emitting apparatus 3 includes an acceleration sensor (G sensor) 89 that detects a waving operation (motion) of the light emitting apparatus 3 and the motion light control unit 86 includes a brightness calculating unit 86*a* that calculates a brightness signal in accordance with the acceleration detected by the G sensor 89 and a brightness control unit 86*b* that controls the brightness (light emission intensity) of the LEDs 61 to 63 according to the brightness signal calculated by the brightness calculating unit 86*a*.

Once the function of the motion light control unit 86 becomes on, by operating the three color switches 21 to 23 while moving the light emitting apparatus 3, it is possible to carry out control that changes the brightness of the LEDs 61 to 63 in proportion to the magnitude of the acceleration applied to the light emitting apparatus 3, for example. Accordingly, it is possible to dynamically change the brightness of the LEDs 61 to 63 so as to visually match the amplitude or size (vigor) of various actions where the user shakes and/or waves the light emitting apparatus 3. The motion light control unit 86 may include a function that changes, in addition to brightness or separately to brightness, the function of the light emitting apparatus 3 and/or changes the color pattern of the light emitting apparatus 3 in response to movement of the light emitting apparatus 3 in a predetermined pattern.

When all of the switches 21 to 25 are simultaneously pressed for two seconds repeatedly four times (a sixth switching pattern), the selector unit 81 changes the function of the self-holding unit 87 on and off. The self-holding unit 87 holds the light emission state (on state) of the LEDs 61 to 63 (the seventh function, self-hold function). If the function of the self-holding unit 87 is off, the operation of the R switch 21 that illuminates the red LEDs 61 is a momentary operation (automatic recovery type) that maintains the illuminated state of the red LEDs 61 only so long as the time when the switch 21 is on. If the function of the self-hold unit 87 is on, the operation of the R switch 21 that illuminates the red LEDs 61 switches to the self-hold function for alternating operation (position holding) where the illuminated state of the red LEDs 61 is maintained after switching on. The same applies to the G switch 22 and the B switch 23. If the function of the self-holding unit 87 is on, the fade switch 25 fulfills a function of turning off the LEDs 61 to 63 in the illuminated state according to the self-holding function.

Note that the function of the selector unit 81 according to the present embodiment and the functions of one or all of the inverting switching function control unit 84, the preset unit 85, the motion light control unit 86, and the self-holding unit 87 can be added to the light emitting apparatuses 1 and 2 according to the first and second embodiments. Also, the switching patterns (switching operations) that switch the various functions are not limited to above description and as one example, when the functions of the color switches 21 to 23 are switched to the motion light control function, a slide type motion switch may be provided. This also applies to the switching to other functions.

Although an example where the light emitting unit 50 is equipped with the LEDs 61 to 63 is described in the above embodiment, the light emitting elements are not limited to LEDs and may be other light emitting elements such as organic EL or lasers. The form of the light emitting unit 50 is not limited to a pen type as described above. The construction of the controller 73 is also one example and it is possible to configure the controller 73 of a circuit board that includes a CPU and appropriate circuits for the functions described above. Also, the numerous examples of patterns controlled by the program control unit 82 are mere examples and it is possible for the user to generate unique patterns and store the patterns in advance in the memory. The number of patterns is also not limited to seven and by disposing four switches operated from the index finger to the little finger or even more switches operated by one hand or both hands, it is possible to select a pattern displayed by the light emitting unit 50 from an even larger number of patterns.

The invention claimed is:

1. A light emitting apparatus that is portable and comprises:

a light emitting unit that houses light emitting elements;

a grip that is connected to the light emitting element, a space between the light emitting unit and the grip, through the space fingers pass and hold the grip, and a plurality of switches that control the light emitting elements and are disposed at positions pressed by at least three out of a first finger, a second finger, a third finger, and a fourth finger on the grip when the fingers hold the grip through the space.

2. The light emitting apparatus according to claim 1, wherein the space is an opening provided between the light emitting unit and the grip.

3. The light emitting apparatus according to claim 1, wherein the light emitting apparatus has an overall disc shape or box shape.

4. The light emitting apparatus according to claim 1, further comprising a program control unit that controls, by operation of the plurality of switches, light outputted from the light emitting unit in accordance with one of a plurality of patterns set in advance.

5. The light emitting apparatus according to claim 1, further comprising an order allocation control unit that inverts functions respectively allocated to the plurality of switches.

6. The light emitting apparatus according to claim 1, further comprising a selector switch that switches a function operated by the plurality of switches to other function, the selector switch being disposed on the grip at a position operated by a thumb when the fingers hold the grip through the space.

* * * * *